US008561980B2

(12) United States Patent
Demmeler et al.

(10) Patent No.: US 8,561,980 B2
(45) Date of Patent: Oct. 22, 2013

(54) APPARATUS AND METHOD FOR SINGLING SHEET MATERIAL

(75) Inventors: Erwin Demmeler, Memmingen (DE); Ralf Hobmeier, München (DE); Rainer Stoll, München (DE); Frank Werner, München (DE)

(73) Assignee: Giesecke & Devrient GmbH, Munich (DE)

( * ) Notice: Subject to any disclaimer, the term of this patent is extended or adjusted under 35 U.S.C. 154(b) by 1805 days.

(21) Appl. No.: 10/571,763

(22) PCT Filed: Sep. 8, 2004

(86) PCT No.: PCT/EP2004/010029

§ 371 (c)(1),
(2), (4) Date: Oct. 4, 2006

(87) PCT Pub. No.: WO2005/026026

PCT Pub. Date: Mar. 24, 2005

(65) Prior Publication Data

US 2007/0063421 A1 Mar. 22, 2007

(30) Foreign Application Priority Data

Sep. 15, 2003 (DE) ..... 103 42 568

(51) Int. Cl.
*B65H 3/52* (2006.01)

(52) U.S. Cl.
USPC ..... 271/124; 271/121; 271/109

(58) Field of Classification Search
USPC ..... 271/121, 37, 124, 109
See application file for complete search history.

(56) References Cited

U.S. PATENT DOCUMENTS

| | | | | | |
|---|---|---|---|---|---|
| 3,988,017 | A | * | 10/1976 | Kyhl | 271/111 |
| 4,020,972 | A | * | 5/1977 | Lundblad | 221/13 |
| 4,159,782 | A | * | 7/1979 | Swartzendruber | 221/1 |
| 4,327,904 | A | * | 5/1982 | Holmes | 271/35 |
| 4,494,747 | A | * | 1/1985 | Graef et al. | 271/263 |

(Continued)

FOREIGN PATENT DOCUMENTS

| | | | |
|---|---|---|---|
| DE | 35 03 168 | A1 | 8/1986 |
| DE | 197 29 430 | A1 | 1/1999 |

(Continued)

OTHER PUBLICATIONS

English Abstract of DE 101 40 497 C1.
English Abstract of DE 197 29 430 A1.

*Primary Examiner* — Michael McCullough
*Assistant Examiner* — Howard Sanders
(74) *Attorney, Agent, or Firm* — Bacon & Thomas, PLLC

(57) ABSTRACT

In an apparatus for singling sheet material, multiple picks are avoided by a retaining device ensuring that sheet material entrained with the sheet to be singled is retained not only on one side but also on the other side of the sheet to be singled. While the first retaining device is located opposite a singling gap of the singling device and is continually effective, the second retaining device acts before, or in, the singling gap from the other side of the singling gap and is only activated after the sheet to be singled is reliably grasped by the singling device, and deactivated when it has left the singling gap.

18 Claims, 4 Drawing Sheets

(56) References Cited

U.S. PATENT DOCUMENTS

| | | | | |
|---|---|---|---|---|
| 4,717,137 | A | 1/1988 | Leuthold | |
| 4,955,596 | A * | 9/1990 | Ricciardi | 271/110 |
| 4,958,825 | A | 9/1990 | Onomoto et al. | |
| 6,186,493 | B1 * | 2/2001 | Toriyama | 271/35 |
| 6,224,049 | B1 | 5/2001 | Hosking et al. | |
| 2004/0251592 | A1 * | 12/2004 | Ruhe et al. | 271/109 |

FOREIGN PATENT DOCUMENTS

| | | | |
|---|---|---|---|
| DE | 101 37 390 | A1 | 2/2003 |
| DE | 101 40 497 | C1 | 3/2003 |
| EP | 0 185 395 | | 6/1986 |
| EP | 0 942 887 | B1 | 9/1999 |
| JP | 57181742 | U | 11/1982 |
| KR | 1019890013592 | A | 9/1989 |

* cited by examiner

APPARATUS AND METHOD FOR SINGLING SHEET MATERIAL

BACKGROUND OF THE INVENTION

A. Field

This invention relates to a method for avoiding multiple picks during the singling of sheet material as well as a corresponding apparatus for singling sheet material, in particular for bank note processing machines to which the bank notes to be processed are fed in stacks.

B. Related Art

Such bank note processing machines normally have for this purpose a pocket for receiving a bank-note stack. The bank notes are singled gradually by means of a singler from the upper side or underside of the stack. The singler has as a rule a singling gap which is formed on one side by a singling roller and on the other side by a retaining device, as a rule likewise a roller. A feeding system in the receiving pocket ensures that the bank notes to be singled are fed to the singling gap successively. The singling roller grasps by frictional engagement the furthest protruding one of the bank notes fed in this way. This should normally be the lowermost or uppermost bank note of the bank-note stack. The retaining roller on the opposite side of the singling gap normally stands still, but can in some cases also rotate in the opposite direction, thereby retaining the bank notes fed with the lowermost or uppermost bank note to the singling gap.

A problem of such apparatuses is the danger of overlapping double picks, multiple picks leading to continuous bands of bank notes, and blockage of the singler by wedging of bank notes in the singling gap. Such problems appear primarily when bank notes of mixed denomination with different formats are contained in the stack or when the bank notes are not carefully prestacked and the leading edges of the bank notes are spaced within the bank-note stack at very different distances from the singling gap. Such difficulties are to be observed especially with those receiving pockets that serve not only for inputting but also for outputting bank notes. With such pockets, bank notes not recognized by the bank note processing machine (so-called "rejects") are restacked into a divided-off area of the pocket and frequently merely reinserted into the main pocket by an operator for a second run, or, e.g. if bank note processing is stopped, the already processed bank notes are restacked onto the not yet singled remaining stack and singled again in a second run. In such cases it happens that not the lowermost or uppermost bank note is grasped and singled during the singling process, but for example the third or fourth bank note, because its leading edge is much closer to the singling gap than the leading edges of the bank notes therebelow or thereabove. When this bank note protruding from the stack is grasped by the singling gap and pulled out of the bank-note stack, it pulls along adjacent bank notes, possibly resulting in the above-mentioned double picks, bank-note bands or a jam due to formation of a bank-note wedge in the singling gap. The retaining device retains the bank notes on one side of the bank note grasped by the singling gap. However, the bank notes pulled along on the other side of the grasped bank note, which originally should have been singled before the actually grasped bank note, are not influenced by the retaining device. They are then entrained with the actually grasped bank note as a double or multiple pick.

EP 0 942 887 B1 relates to an apparatus for singling sheet material which reduces the risk of multiple picks. In contrast to conventional apparatuses in which the feeding system for feeding the bank notes to the singling gap, which normally consists of feeding rollers or bands acting on the sheet stack from below or above, and the singling roller are coupled with each other synchronously via a common drive, different drives are provided according to the teaching of EP 0 942 887 B1 for the feeding system, on the one hand, and the singling roller, on the other hand. This permits the feeding system to be switched off after the singling roller has grasped a bank note, so that the singling roller completely takes over the picking function as of this moment. The feeding system thus in any case no longer has any supporting transport effect on those bank notes that are entrained with a singled bank note and should originally have been singled before it. However, EP 0 942 887 B1 does not relate to the concrete case of the double or multiple pick, which arises when another bank note of the bank-note stack is grasped instead of the bank note originally to be singled, and the bank note originally to be singled is entrained at the same time. Therefore, EP 0 942 887 B1 does not propose any concrete solution to this concrete problem. Furthermore, for reasons of space and cost it is not always possible to provide two separate drives or a corresponding gearing for separate control of the feeding system, on the one hand, and the singling roller, on the other hand.

EP 0 942 887 B1 also proposes feeding the bank notes by means of the feeding system against the singling roller standing still. This is also possible due to the separate drives. However, this as a rule does not obtain the result that adjacent bank notes are shifted relative to each other in such a way that the leading edge of a bank note to be singled is fed to the singling gap up to the level of a leading edge of another bank note protruding from the stack, or beyond it. Instead, it is also to be expected in this case that the protruding leading edge of the other bank note will be grasped by the singling gap first. In particular, this can additionally favor a wedging of bank notes in the singling gap under the stated circumstances.

EP 0 185 395 B1 describes an apparatus for singling bank notes wherein the bank-note stack to be singled is pushed with some momentum into the sheet store out of which the sheet material is then singled. In this singling apparatus, wherein the uppermost sheet of the sheet stack is always fed to the singling gap by means of compressed air and grasped by the singling roller by a vacuum, there was the problem of wedging in the singling gap upon insertion of the sheet stack into the sheet store due to the momentum with which the sheet stack slid through to the singling gap. To avoid this wedging, EP 0 185 395 B1 proposes a retaining apparatus with which a feeding gap between the sheet store and the singling gap is always closed when a new sheet stack is pushed into the sheet store. Before the onset of singling of the sheet material, the retaining device is withdrawn from the feeding gap so that the feed of the uppermost sheet to the singling gap can be effected by means of compressed air. The measure proposed in EP 0 185 395 B1 prevents wedging of sheet material in the singling gap, but does not ensure that the leading edge of the uppermost bank note to be singled is closest to the singling gap. If this is not the case and for example when the uppermost bank note is fed a bank note is entrained whose leading edge is closer to the singling gap, this note is grasped by the singling roller and entrains the bank note originally to be singled and any bank notes therebetween, which can lead to double or multiple picks and possibly to a jam due to wedging in the singling gap, which was originally to be prevented.

The problem of the present invention is therefore to avoid multiple picks during the singling of sheet material of a sheet stack.

This problem is solved by a method and apparatus having the features of the coordinated claims. Advantageous embodiments and developments of the invention are stated in dependent claims.

Accordingly, a further retaining device is provided. While the above-mentioned retaining roller or corresponding retaining device ensures that no sheet material is entrained with the singled sheet on the side of the singling gap facing away from the singling roller during singling by means of the singling roller, the further, separate retaining device acts on the fed sheet material before or in the singling gap from the opposite side of the singling gap. However, said further retaining device is only activated and therefore only acts on the sheet material fed to the singling gap after a sheet has been reliably grasped by the singler and has preferably already reached the downstream transport device. The singling roller and/or transport device then draws the sheet in question completely out of the sheet stack, while sheet material entrained between the singling roller (or equivalent singling device) and the sheet in question is retained by the further, separate retaining device.

According to a first embodiment of the invention, the further retaining device comprises friction elements which are urged against the sheet stack from above or from below depending on whether the sheet stack is being singled from above or from below. Entrained sheet material is thus braked and retained.

To retain the entrained sheet material even in the case of greatly overlapping sheets, it is advantageous to place the friction elements as close to the singling gap as possible. It is particularly advantageous if the retaining device acts on the sheet material to be retained in the singling gap or in a feeding gap between the singling gap and the sheet stack, by the singling gap or feeding gap being constricted, or—in the case of a regular pick—even completely closed, upon activation of the retaining element. The retaining device can have for example friction elements which are usually inserted into circumferential grooves of the singling roller so that in the non-activated state they neither hinder rotation of the singling roller nor act on the sheet material to be singled. Upon activation, the friction elements are moved out of the grooves, for example by means of a suitable lever mechanism, and constrict or close either the singling gap or a feeding gap before the singling gap (in the transport direction). For this purpose, the friction elements preferably have suitable friction linings, in particular made of rubber, on the side facing the sheet material to be contacted. Entrained sheet material is thus jammed to some extent in the singling gap or in the feeding gap.

The time coordination of the activation and deactivation of the retaining device with the transport of the bank notes to be singled is possible in different ways. The moment for activating the retaining element—that is the moment when the sheet to be singled has been reliably grasped by the singler or when it has preferably reliably reached a transport device downstream of the singler—can be determined for example by means of a light barrier by detecting when the leading edge of the picked bank note has reached the first transport nip of the transport device. The moment for deactivating the retaining device can be determined by means of a further light barrier by detecting for example when the trailing edge of the picked bank note has left the singling gap. The deactivation moment can also be determined indirectly with consideration of the transport speed of the transport system and the maximum length (e.g. 180 mm) of the sheet material to be singled.

Finally, the moments for activating and deactivating the retaining device can also be recognized solely or additionally with reference to the phase angle of the singling roller. The singling roller has friction segments at a defined place on its circumference which, when they come in contact with the leading edge of the sheet to be singled, grasp said leading edge and thus start the singling process. The retaining device is activated when the singling roller has rotated by such a phase angle that ensures that the leading edge of the sheet to be singled has been grasped by the transport device, and is deactivated again when the singling roller has rotated by a further phase angle that ensures that even a sheet with maximum length has left the singling gap.

Activation and deactivation of the retaining device can be effected by means of a separate actuator which reacts for example to the signals of the light barriers. However, activation and deactivation of the retaining device on the basis of certain phase angles of the singling roller also opens up the possibility of passive control by means of a cam coupled with the singling roller or by means of other gearing elements. The cam is then so disposed that it moves the retaining elements of the retaining device to their active position when the singling roller has reached a first defined phase angle, and to their inactive position when the singling roller traverses a second defined phase angle.

While the above-mentioned embodiments aim at proper processing of a double or multiple pick, the measure described hereinafter, which can be combined with the above-mentioned measures, aims at reducing the danger of this problematic case occurring from the start. The retaining device is disposed here, as explained above, so that it can close a feeding gap between the singling gap and the sheet stack. However, while this closing or constricting served in the hitherto explained embodiments to brake and thereby retain entrained sheet material, the retaining device can instead also be used to close the feeding gap and keep it closed when a sheet stack is inserted into the sheet store. To make sure that the uppermost or lowermost sheet to be singled is actually grasped by the singling roller first, the sheet in question is first preliminarily conveyed against the closed feeding gap by means of the feeding system. This process can last several singling cycles, but no singling occurs since the banknote stack is separated mechanically from the singling roller by the retaining device.

Activation and deactivation of the retaining device can again be effected by means of a separate actuator. However, it is advantageous to use drive devices already contained in the system. In connection with bipartite pockets for receiving the sheet stack and for reoutputting rejects, as explained at the outset, a drive is for example already present for a movable intermediate plate which subdivides the pocket and on which the rejects are restacked. A preferred embodiment of the invention therefore provides for coupling the activation and deactivation of the retaining device with the motion of the intermediate plate.

A further idea of the present invention, which can also be used independently of the subject matter of the main claims, is the following.

If the sheet stack is placed on a support of the input pocket of the singler, it is normally pushed with the help of feed rollers integrated in the support toward the singling gap which is possibly still closed. The feed rollers are at the same time rotated by a given amount.

If, as described in DE 101 37 390 A1 from the applicant, a sensor is now provided which monitors during singling whether the next bank note to be singled is moving at the moment of singling, it can not only be detected whether the singling order has been mixed up. It is also possible to control the feed rollers individually in dependence on the signals of said sensor, i.e. to drive the feed rollers for different lengths of time depending on the actual position measured by the sensor, until the stack has been fed to the desired singling position.

BRIEF DESCRIPTION OF THE DRAWINGS

Although the invention will hereinafter be described in more detail with reference to the accompanying drawings by the example of the singling of bank notes, it is not restricted to this application. Any kind of sheet material can be singled in the way described hereinafter, in particular value documents other than bank notes, such as checks, shares and the like. The figures are described as follows.

DETAILED DESCRIPTION OF PREFERRED EMBODIMENTS OF THE INVENTION

Figure 1:
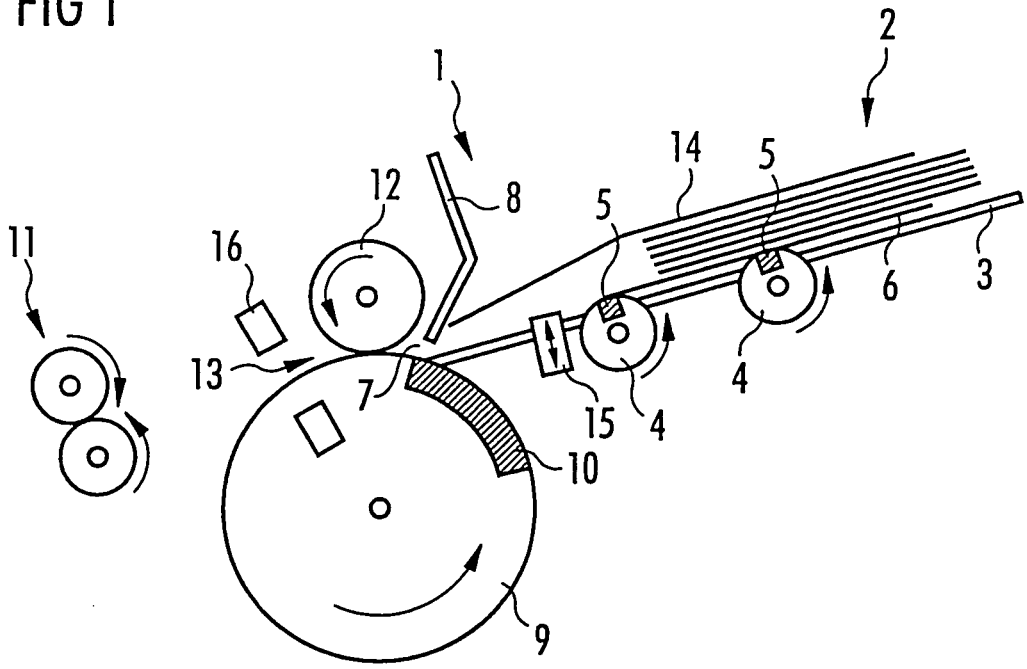
FIG. 1 shows schematically an apparatus for singling sheet material according to a first embodiment.

FIG. 1 shows schematically an apparatus for singling sheet material according to a first embodiment. In a sheet store 1 a bank-note stack 2, comprising only seven bank notes here by way of example, rests on a supporting plate 3. The supporting plate 3 has feed wheels 4 with friction linings 5 reaching therethrough which, by rotation in the direction of the arrows, transport the sheet stack 2 and in particular the lowermost sheet 6 resting directly on the feed wheels 4 toward a feeding gap 7 against a stop face 8 of the sheet stack store 1. A singling roller 9 grasps the leading edge of the bank note lying against the feeding gap 7, with a friction segment 10 having a considerably higher coefficient of friction than the remaining circumference of the singling roller. The thus grasped bank note is guided on by rotation of the singling roller 9 in the direction of the arrow to a downstream transport system 11, of which only the first transport nip is shown schematically in FIG. 1.

A retaining roller 12 forms together with the singling roller 9 a singling gap 13 through which the bank notes are singled. The retaining roller 12 has a transport function, acting contrary to the singling direction, on the bank note located in the singling gap 13. However, since the retaining roller, due to a smaller coefficient of surface friction, exerts a smaller transport effect on the bank note than the singling roller 9 with its friction lining 10, the lowermost bank note 6 is reliably pulled away under the bank-note stack 2 while bank notes thereabove are retained in the feeding gap 7 by the retaining roller 12.

Normally, the leading edge of the lowermost bank note 6 always lies against the feeding gap 7 due to the transport effect of the feed wheels 4, so that the bank-note stack 2 is singled gradually beginning with the lowermost bank note 6. In the exceptional cases stated at the outset, however, it can happen that the bank-note stack 2 lies against the feeding gap 7 with the leading edge of a relatively long bank note 14 which is not the lowermost bank note, as shown in FIG. 1. Further bank notes could also be stacked above the bank note 14. In such a case, not the lowermost bank note 6 is therefore grasped by the singling roller 9 and singled, but rather the bank note 14 thereabove, there being a danger of entrainment of the bank notes therebelow which should originally have been singled before the bank note 14. This can result in double picks, bank-note bands due to multiple picks, or blockage of the system by wedging of bank notes in the feeding gap 7.

To avoid double or multiple picks by entrainment of bank notes located under the actually singled bank note 14, a retaining device is now provided that comprises a retaining element 15 which is raised at a suitable moment from below against the bank-note stack 2 and the entrained bank notes, i.e. in particular against the lowermost bank note 6, to brake the motion of the entrained bank notes and thereby retain them. The retaining element may be one or more friction elements with a high coefficient of friction which can be inserted through the supporting plate 3 from below and are moved by a lifting magnet for example.

Activation of the retaining element 15 is expediently effected at the earliest when the leading edge of the bank note 14 singled from the sheet stack 2 has reached the singling gap 13. To be on the safe side, however, the retaining element 15 is only activated when the leading edge of the bank note in question has run into the first transport nip of the transport system 11, since this ensures reliable further transport of the bank note.

The leading edge of the bank note in question can be detected in simple fashion by means of a light barrier 16. In the embodiment according to FIG. 1, the light barrier 16 is disposed immediately behind the singling gap 13. This has the advantage that the same light barrier 16 can also detect the trailing edge of the bank note when it leaves the singling gap 13. When the trailing edge of the bank note leaves the singling gap 13, the retaining element 15 can be deactivated again.

If activation of the retaining element 15 is not already to be effected when the leading edge of the bank note in question is grasped in the singling gap 13, but only when the leading edge runs into the first transport nip of the downstream transport system 11, a further light barrier after the first transport nip is not necessarily required. The grasping of the leading edge at the singling gap 13 with consideration of the transport speed exerted by the singling roller 9 on the bank note to be singled makes it possible to readily predetermine the moment when the leading edge of the bank note runs into the transport system 11. A single light barrier 16 at or after the singling gap 13 is thus sufficient for determining the moment of activating and deactivating the retaining element 15.

Furthermore, it is not absolutely necessary to detect the trailing edge of the picked bank note. If the maximum length of the bank notes to be singled and the transport speed of the singling roller 9 are known, such information makes it possible to determine without problems the length of time within which the bank note to be singled must definitely have left the singling gap 13. At the end of this length of time, the retaining element 15 is then deactivated.

Finally, a light barrier or similar detection device can also be completely omitted, as to be explained more closely below in connection with a second embodiment with reference to FIG. 3, if solely the phase angle of the singling roller 9 is relevant for activating and deactivating the retaining element 15.

Figure 2:
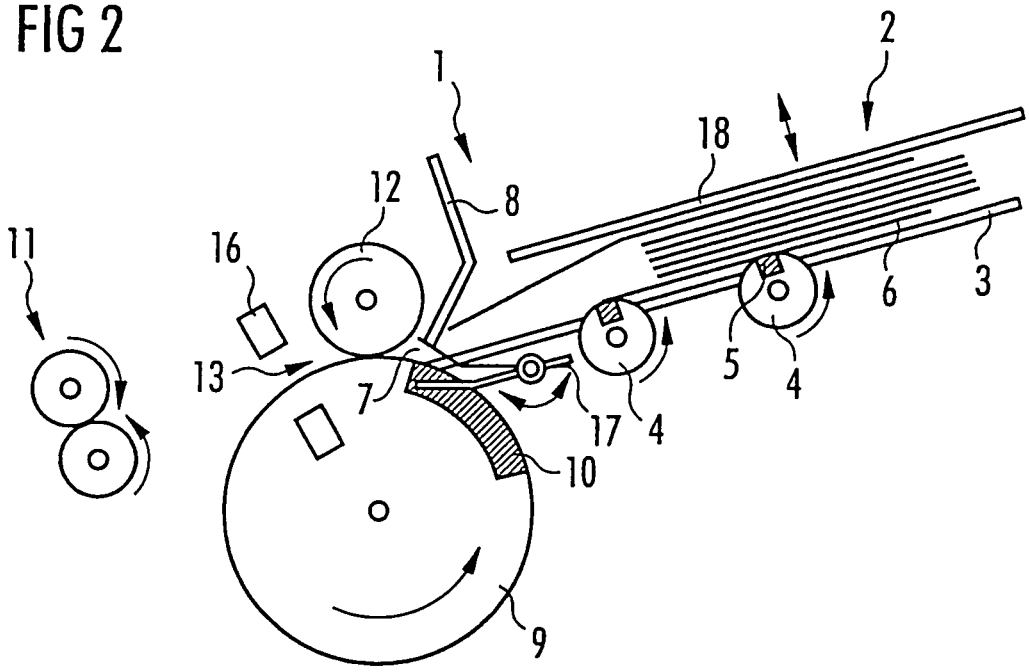
FIG. 2 shows schematically an apparatus for singling sheet material according to a second embodiment.

FIG. 2 shows a second embodiment which differs from the first embodiment according to FIG. 1 substantially only in that the retaining device has, instead of the retaining element 15, a blocking element 17 which serves to constrict or close the feeding gap 7. The blocking element is activated and deactivated for the same purpose and at the same moments as the retaining element 15 described with respect to FIG. 1.

Activating the blocking element 17 causes the feeding gap 7 to be constricted or closed, thereby causing a clamping force to act on the sheet material, and a frictional force on moving sheet material, which brakes the bank note 6 entrained under the bank note 14 grasped by the singling gap 13, thereby retaining it from the singling gap 13. The surface of the blocking element 17 contacting the bank notes has for this purpose a relatively high coefficient of friction, for example through a glued-on friction lining, e.g. made of rubber.

Entrained sheet material is in this way clamped to some extent in the singling gap or in the feeding gap. However, the clamping force should not be too great since otherwise there is a risk of the sheet material tearing. It should merely support retention sufficiently and be for example 0.3 times the retaining force acting on the bank notes.

The embodiment according to FIG. 2 has an essential advantage over the embodiment described with respect to FIG. 1 in that the retaining device takes effect much closer to the singling gap 13. This permits greatly overlapping bank notes with a lap of for example 90% to still be separated from each other. In the embodiment according to FIG. 1, in contrast, the trailing edge of an entrained bank note could already have left the range of action of the retaining element 15 in the case of such high laps, so that the retaining device according to FIG. 1 would be ineffective in such cases.

However, the retaining device according to the embodiment of FIG. 2 has a further decisive advantage over the embodiment of FIG. 1. The blocking element 17 can be used not only to keep unintentionally entrained bank notes away from the singling gap 13 upon each bank note pick, but it can also be used to reduce the danger of such double and multiple picks from the start. For this purpose, the feeding gap 7 is first closed by means of the blocking element 17 before the singling of bank notes from the sheet stack 2 is started. With the feeding gap 7 closed, the singling mechanism is then switched on, i.e. the feed wheels 4 rotate in the usual way in synchronism with the singling roller 9. This causes the sheet stack 2 and in particular the lowermost bank note 6 to be transported to the feeding gap 7. However, no singling by the likewise rotating singling roller 9 occurs yet due to the activated blocking element 17 closing the feeding gap 7. After several rotation cycles this process is completed and the blocking element 17 is moved back to the inactive position so that the singling process can be started.

The onset and end of this start-up phase with the feeding gap 7 closed. i.e. the activation and subsequent deactivation of the blocking element 17, are coupled to the motion of an intermediate plate 18 movable in the direction of the double arrow. The intermediate plate 18 subdivides the sheet stack store 1 into an area below the intermediate plate 18 which receives the sheet stack to be singled, and an area above the intermediate plate 18 on which bank notes that are singled but not recognized by the system (rejects) are output again. Since said intermediate plate 18 already has a drive mechanism as well as sensor means for detecting different positions of the intermediate plate, it is expedient to couple the activation and deactivation of the blocking element 17 to the same drive mechanism. This means that when the intermediate plate is moved to a first position, this activates the blocking element 17, and when the intermediate plate is moved to a second position, this deactivates the blocking element 17 again. The particular positions of the intermediate plate are detected by sensor means, e.g. light barriers, already present, to thereupon start or turn off the main motor and engage or disengage the singler.

FIG. 2 indicates that in the deactivated state the blocking element 17 is located below the circumferential surface of the singling roller 9, namely in a groove of the singling roller, so as not to hinder either the motion of the singling roller 9 or the transport of the bank notes to be singled (position 2). Upon activation of the retaining device the blocking element 17 is swiveled out of the groove of the singling roller 9 by means of a spring mechanism (not shown) to close the feeding gap 7 (position 1). Instead, the blocking element 17 could also be formed in any other way. Instead of closing or constricting the feeding gap 7, the blocking element 17 can also act directly in the singling gap 13 and close or constrict it.

Figure 3:
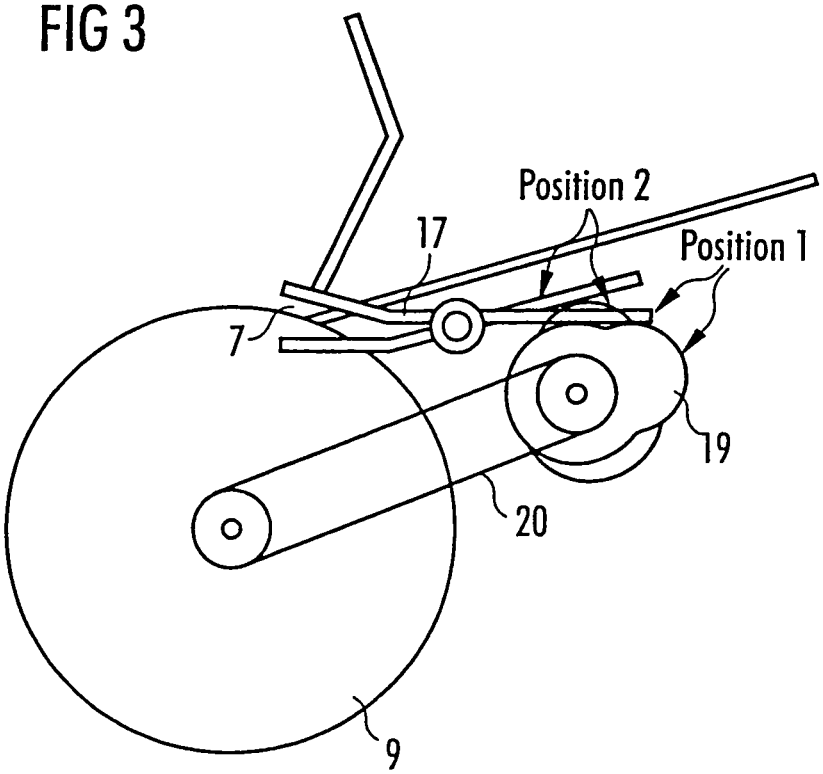
FIG. 3 shows by way of example a drive mechanism for the embodiment according to FIG. 2.

FIG. 3 shows by way of example and only schematically a passive control for activating and deactivating the blocking element 17 from FIG. 2, which can also be used in corresponding fashion for activating and deactivating the retaining element 15 according to the embodiment of FIG. 1. The essential element of said passive activation and deactivation is the kinematic coupling of the blocking element 17 with the rotation of the singling roller 9. Accordingly, coupling a cam 19 with the drive shaft of the singling roller 9 via a circulating belt 20 obtains the result that the blocking element 17 running on the cam 19 is brought into its active or inactive position relative to the feeding gap 7 at a defined phase angle of the singling roller 9. Other constructional solutions for passive control of the retaining device are likewise conceivable.

Further, it can e.g. be provided in the above-described variants that a sensor (not shown) is provided for monitoring in the input pocket the position of the lowermost sheet 6 to be singled next. Said sensor can e.g. be integrated in the supporting plate 3 near the singling gap 13. The feed wheels 4 integrated in the supporting plate 3 for feeding the bank-note stack 2 toward the singling gap 13, which is possibly still closed, are now driven for different lengths of time in dependence on the actual position of the lowermost bank note measured by the sensor, to feed the bank-note stack 2 to the desired singling position.

Figure 4:
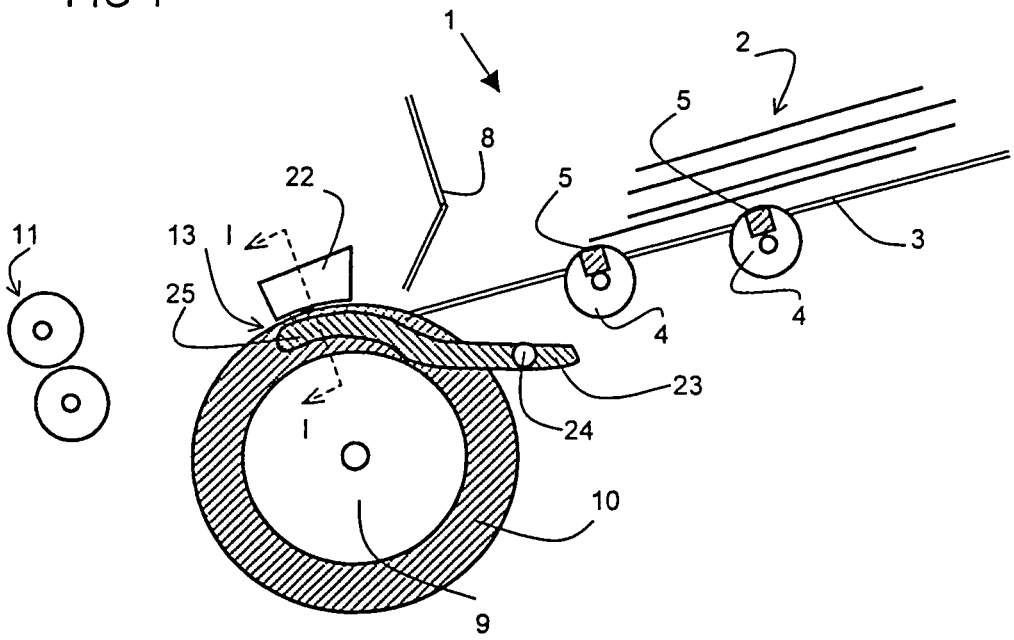
FIG. 4 shows schematically an apparatus for singling sheet material according to a third embodiment in a first operating position.
Figure 5:
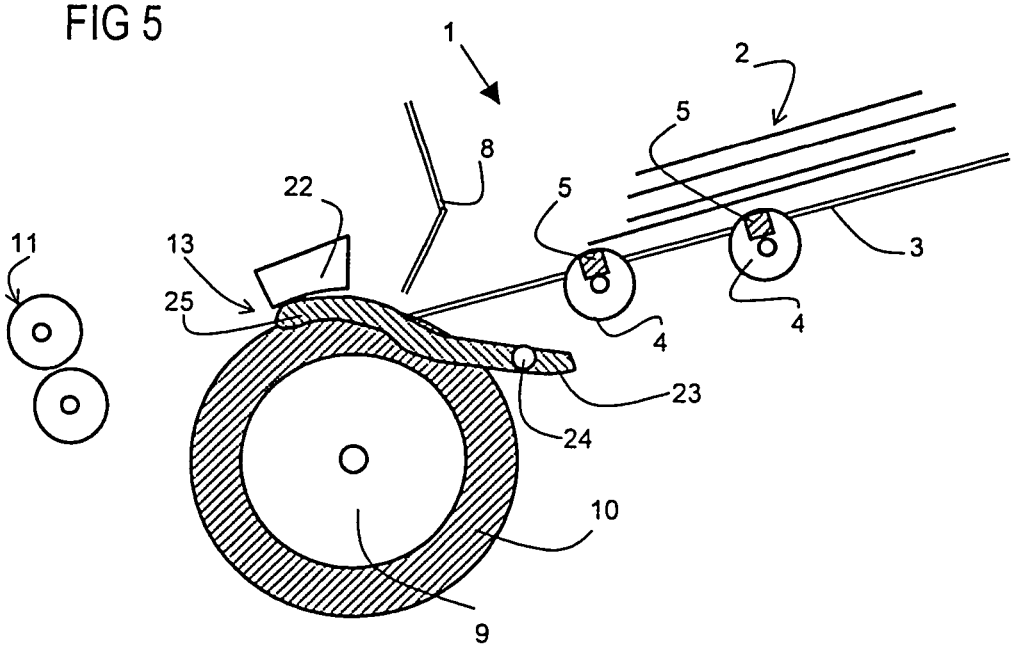
FIG. 5 shows the apparatus of FIG. 4 in a second operating position.
Figure 6:
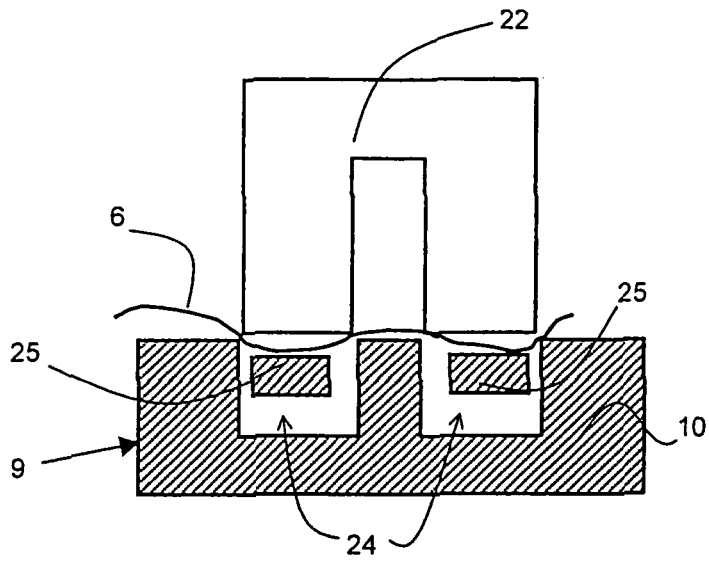
FIG. 6 shows a cross section along the line I-I in FIG. 4.

With reference to FIGS. 4 to 6, a third embodiment will now be described. The apparatus differs from those described above in particular in that there is a means 23 for actively adjusting the retaining device 22, which can urge the retaining device 22 away from the area of the singling gap 13. The retaining device is in this case a retaining runner 22 by way of example. Preferably, said means 23 for actively adjusting the retaining device 22 is a rocker with two fingers 25 mounted rotatably around an axle 24. The fingers 25 are mounted actively adjustably e.g. in the recesses 24 provided for engagement of the retaining runner 22 in the singling roller 9.

Further, the friction segments 10 in this case extend over the total circumference of the singling roller 9.

The apparatus according to FIGS. 4 to 6 can be operated as follows. During an ongoing singling process for singling a bank-note stack 2 inserted into the sheet store 1, the singling roller 10 rotates permanently. In the state shown in FIGS. 4 and 6, the fingers 25 are sunk completely within the recesses 24 of the singling roller 9, so that the lowermost bank note 6 fed by the feed wheels 4 can be picked singly from the stack 2.

To now produce a gap in the stream of singled bank notes in the desired way, the fingers 25 are adjusted actively out of the recesses 24 upward toward the retaining runner 22, being driven by a control device (not shown), until the fingers 25 have urged the retaining runner 22 away from the singler roller 9 a little, e.g. only 0.5 to 1.0 mm. FIG. 5 strongly exaggerates, for clarity's sake, this state in which the retaining runner 22 is spaced from the singling roller 9.

To single the subsequent bank note in the stack 2, the fingers 25 are subsequently sunk back into the recesses 24 into the position shown in FIGS. 4 and 6.

The variant in which the singling roller 9 can be permanently rotated permits high singling speeds.

The invention claimed is:

1. A method for avoiding multiple picks during the singling of sheet material from a sheet stack comprising the steps of:

feeding sheet material in a transport direction from the sheet stack to a singling gap by means of a feeding device, said singling gap having a first gap side and a second gap side opposite the first gap side, said first gap side defined as facing a first side of the sheet material when passing the singling gap, said second gap side defined as facing a second side of said sheet material when passing the singling gap, and singling the fed sheet material in the singling gap by grasping a sheet of the fed sheet material from the first gap side of the singling gap and guiding on the grasped sheet to a transport device while simultaneously retaining further sheets of the fed sheet material on the second gap side, after the leading edge of the guided-on sheet has reached a position after the singling gap in the transport direction, activating a retaining device different from the feeding device, which acts, in or before, relative to the transport direction, the singling gap, on the fed sheet material from the first gap side and retains sheet material carried along with the guided-on sheet.

2. The method according to claim 1, wherein the retaining device comprises one or more friction elements, and the step of retaining the carried-along sheet material comprises the step of urging the friction elements against the sheet stack.

3. The method according to claim 1, wherein the step of retaining the carried-along sheet material comprises the step of constricting or closing the singling gap or a feeding gap located between the sheet stack and the singling gap.

4. The method according to claim 1, including deactivating the retaining device after the guided-on sheet has left the singling gap.

5. The method according to claim 4, wherein the step of grasping a sheet of the fed sheet material is effected by means of a singling roller, and the retaining device is deactivated when the singling roller has rotated by a given angle after activation of the retaining device.

6. The method according to claim 5, wherein the steps of activating and deactivating the retaining device are effected by means of a cam coupled with the singling roller.

7. An apparatus for singling sheet material comprising a sheet store for receiving a sheet stack, a feeding device for feeding sheet material in a transportation direction from the sheet store to a singling gap, a singling device and a first retaining device, the singling device and the first retaining device forming the singling gap, said singling gap having a first gap side and a second gap side opposite the first gap side, said first gap side defined as facing a first side of the sheet material when passing the singling gap, said second gap side defined as facing a second side of said sheet material when passing the singling gap, wherein the singling device is arranged on the first gap side and adapted to grasp a sheet of the sheet material fed to the singling device and also arranged for guiding on the grasped sheet to a transport device, and the first retaining device is adapted for retaining further sheets of the sheet material fed to the singling device, and a second retaining device different from the feeding device, which is disposed in or before, relative to the transport direction, the singling gap, and acts on the fed sheet material from the first gap side, and a control device by means of which the second retaining device is brought into operational engagement with the fed sheet material after the leading edge of the sheet guided on to the transport device has reached a position after the singling gap in the transport direction.

8. The apparatus according to claim 7, wherein the second retaining device comprises friction elements urging against the sheet stack.

9. The apparatus according to claim 8, wherein the second retaining device comprises a blocking element for constricting or closing the singling gap or a feeding gap located between the sheet stack and the singling gap.

10. The apparatus according to claim 7, wherein the second retaining device is deactivated by means of the control device after the guided-on sheet has left the singling gap.

11. The apparatus according to claim 10, wherein the singling device has a singling roller for grasping a sheet of the fed sheet material, and the second retaining device is deactivated by means of the control device when the singling roller has rotated by a given angle after activation of the second retaining device.

12. The apparatus according to claim 11, including a cam coupled with the singling roller, for activating and deactivating the second retaining device.

13. The apparatus according to claim 7, including a sensor for detecting the position of the next sheet to be singled in the sheet stack store.

14. The apparatus according to claim 13, wherein the feeding device for feeding sheet material from the sheet store to the singling gap is driven in dependence on signals of the sensor for detecting the position of the next sheet to be singled in the sheet stack store.

15. An apparatus for singling sheet material comprising:

a sheet store for receiving a sheet stack, a feeding device for feeding sheet material from the sheet store to a singling gap, a feeding gap between the sheet stack store and the singling gap, a retaining device for closing the feeding gap, and a control for closing and opening the feeding gap by means of the retaining device and for activating the feeding device in such a way that before the singling of sheet material from the sheet stack the feeding device is active for a given time with the feeding gap closed;

wherein the sheet stack store is subdivided by an adjustable intermediate plate and has, for adjustment, a drive with which the retaining device is also coupled.

16. An apparatus for singling sheet material comprising:

a sheet store for receiving of a sheet stack, a feeding device for feeding sheet material in a transportation direction from the sheet store to a singling gap, a singling device and a first retaining device, the singling device and the first retaining device forming the singling gap, the singling gap having a first gap side and a second gap side opposite the first gap side, said first gap side facing a first side of the sheet material when passing the singling gap and said second gap side facing a second side of the sheet material when passing the singling gap, wherein the singling device is arranged on the first gap side and adapted to grasp a sheet of the sheet material fed to the singling device and for guiding on the grasped sheet to a transport device, and the first retaining device is adapted for retaining further sheets of the sheet material fed to the singling device, and adjustment means for actively adjusting the first retaining device to permit the first retaining device to be urged away from the area of the singling gap by said adjustment means;

wherein the means for actively adjusting the retaining device have one or more elements which are mounted actively adjustably in recesses of the singling device.

17. The apparatus according to claim 16, wherein said one or more elements comprise fingers mounted rotatably around an axle.

18. An apparatus for singling sheet material comprising:

a sheet store for receiving of a sheet stack, a feeding device for feeding sheet material in a transportation direction from the sheet store to a singling gap, a singling device and a first retaining device, the singling device and the first retaining device forming the singling gap, the singling gap having a first gap side and a second gap side opposite the first gap side, said first gap side facing a first side of the sheet material when passing the singling gap and said second gap side facing a second side of the sheet material when passing the singling gap, wherein the singling device is arranged on the first gap side and adapted to grasp a sheet of the sheet material fed to the singling device and for guiding on the grasped sheet to a transport device, and the first retaining device is adapted for retaining further sheets of the sheet material fed to the singling device, and adjustment means for actively adjusting the first retaining device to permit the first retaining device to be urged away from the area of the singling gap by said adjustment means, wherein the adjustment means is arranged to urge the first retaining device away from the singling device.

* * * * *